US011859495B2

(12) United States Patent
Lindsey

(10) Patent No.: US 11,859,495 B2
(45) Date of Patent: Jan. 2, 2024

(54) ROTARY PISTON AND CYLINDER DEVICE WITH SINGLE STATOR SIDE

(71) Applicant: LONTRA LIMITED, Warwickshire (GB)

(72) Inventor: Stephen Francis Lindsey, Warwickshire (GB)

(73) Assignee: LONTRA LIMITED, Warwickshire (GB)

( * ) Notice: Subject to any disclaimer, the term of this patent is extended or adjusted under 35 U.S.C. 154(b) by 95 days.

(21) Appl. No.: 16/329,859

(22) PCT Filed: Sep. 1, 2017

(86) PCT No.: PCT/GB2017/052561
§ 371 (c)(1),
(2) Date: Mar. 1, 2019

(87) PCT Pub. No.: WO2018/042199
PCT Pub. Date: Mar. 8, 2018

(65) Prior Publication Data

US 2019/0234215 A1 Aug. 1, 2019

(30) Foreign Application Priority Data

Sep. 2, 2016 (GB) ..... 1614975

(51) Int. Cl.
*F01C 3/02* (2006.01)
*F01C 21/08* (2006.01)
(Continued)

(52) U.S. Cl.
CPC ..... *F01C 3/02* (2013.01); *F01C 3/025* (2013.01); *F01C 21/08* (2013.01); *F01C 21/104* (2013.01);
(Continued)

(58) Field of Classification Search
CPC .. F01C 3/02; F01C 3/025; F01C 21/08; F01C 21/104; F01C 21/02; F04C 2250/201; F04C 2250/20; F04C 2250/30
See application file for complete search history.

(56) References Cited

U.S. PATENT DOCUMENTS 1,735,477 A 11/1929 Stuart
2,327,089 A 8/1943 Walter
(Continued)

FOREIGN PATENT DOCUMENTS

CH 107274 10/1924
CH 276236 6/1951
(Continued)

OTHER PUBLICATIONS

International Search Report issued in corresponding International Patent Application No. PCT/GB2017/052561 dated Nov. 8, 2017.
(Continued)

*Primary Examiner* — Dominick L Plakkoottam
*Assistant Examiner* — Paul W Thiede
(74) *Attorney, Agent, or Firm* — Whiteford, Taylor & Preston, LLP; Peter J. Davis

(57) ABSTRACT

A rotary piston and cylinder device (1) comprising: a rotor (2), comprising a rotor surface (2*a*), a piston (5) which extends from the rotor surface, a stator (4), a rotatable shutter (3), the rotor surface and the stator together defining an annular chamber, and the piston arranged to rotate, through the annular chamber, wherein when the chamber is viewed in axial cross-section, substantially a single surface of the stator in part defines the chamber (100).

15 Claims, 5 Drawing Sheets

(51) Int. Cl.
*F01C 21/10* (2006.01)
*F01C 21/02* (2006.01)

(52) U.S. Cl.
CPC ..... *F01C 21/02* (2013.01); *F04C 2250/20* (2013.01); *F04C 2250/201* (2013.01); *F04C 2250/30* (2013.01)

(56) References Cited

U.S. PATENT DOCUMENTS

| | | | | | |
|---|---|---|---|---|---|
| 3,708,249 | A * | 1/1973 | Luthi | F04C 13/002 417/205 |
| 4,484,872 | A | 11/1984 | Ohtsuki | |
| 6,547,545 | B1 * | 4/2003 | Jonsson | F01C 3/02 418/195 |
| 7,153,112 | B2 * | 12/2006 | Zarnoch | F04C 18/52 418/196 |
| 2009/0148323 | A1 * | 6/2009 | Scheen | F04C 18/52 418/200 |

FOREIGN PATENT DOCUMENTS

| | | | | |
|---|---|---|---|---|
| CN | 101025090 | | 8/2007 | |
| CN | 101061316 | | 10/2007 | |
| CN | 101421492 | A * | 4/2009 | B01J 19/249 |
| DE | 102012208511 | | 11/2013 | |
| EP | 0597731 | | 11/1993 | |
| EP | 0933500 | | 8/1999 | |
| EP | 0933500 | A1 * | 8/1999 | F01C 11/004 |
| FR | 2178346 | | 11/1973 | |
| GB | 2438859 | | 12/2007 | |
| GB | 2528507 | A * | 1/2016 | F01C 11/004 |
| WO | WO-2010023487 | A2 * | 3/2010 | F01C 3/02 |
| WO | 2016012804 | | 1/2016 | |

OTHER PUBLICATIONS

Office Action issued in corresponding European Patent Application No. 17764636.1 dated Mar. 12, 2020.
Office Action issued in corresponding Eurasian Patent Application No. 201990476/31 dated Apr. 6, 2020.
Office Action issued in corresponding Chinese Patent Application No. 201780067395.9 dated Aug. 4, 2020.
Notification issued in co-pending Eurasian Application No. 201990476 dated Dec. 14, 2020.
Office Action issued in co-pending Japanese Application No. 2019-512239 dated Aug. 24, 2021.

* cited by examiner

ROTARY PISTON AND CYLINDER DEVICE WITH SINGLE STATOR SIDE

TECHNICAL FIELD

The present invention relates generally to rotary piston and cylinder devices.

BACKGROUND

Rotary piston and cylinder devices can take various forms and be used for numerous applications, such as an internal combustion engine, a compressor such as a supercharger or fluid pump, an expander such as a steam engine or turbine replacement, or as another form of positive displacement device.

A rotary piston and cylinder device may be considered to comprise a rotor and a stator, the stator at least partially defining an annular chamber or cylinder space, the rotor may be in the form of a ring or annular (concave in section) surface, and the rotor comprising at least one piston which extends from the rotor into the annular cylinder space, in use the at least one piston is moved circumferentially through the annular cylinder space on rotation of the rotor relative to the stator, the rotor being sealed relative to the stator, and the device further comprising a cylinder space shutter which is capable of being moved relative to the stator to a closed position in which the shutter partitions the annular cylinder space, and to an open position in which the shutter permits passage of the at least one piston, such as by the shutter being rotatably mounted, the cylinder space shutter may be in the form of a shutter disc.

We have devised a novel configuration of a rotary piston and cylinder device.

SUMMARY

According to a first aspect of the invention there is provided a rotary piston and cylinder device comprising:

a rotor, comprising a rotor surface, a piston which extends from the rotor surface, a stator, a rotatable shutter, the rotor surface and the stator together defining an annular chamber, and the piston arranged to rotate, through the annular chamber, wherein when the chamber is viewed in axial cross-section, preferably substantially a single surface of the stator may in part define the chamber.

The axial cross-section may be a section along the axis of rotation of the rotor.

The (single) chamber-defining surface, referred to for ease of reference as the stator surface, is preferably a major surface of the stator which defines the chamber.

The stator surface when viewed in axial cross-section may be substantially linear.

The stator surface may be substantially cylindrical.

The stator surface may be substantially frusto-conical. By 'substantially cylindrical' and 'substantially frusto-conical', we allow for the presence of one or more ports being provided in the surface, and so in either case, the shape characteristic referred to need not be continuous or unbroken.

The stator surface may be radially outward of the chamber-defining rotor surface. The stator surface may be viewed as extending around the rotor surface.

The stator surface may alternatively be radially inward of the chamber-defining rotor surface. In this case the stator surface may be viewed as being contained within the rotor surface.

The rotor surface may be of substantially diabolo shape/configuration.

The rotor surface may be substantially symmetrical with respect to a plane extends through a mid-region of the rotor surface, and which plane is perpendicular to the axis of rotation of the rotor.

A mid-region of the rotor surface may be located substantially equidistant between (axial) distal end portions or regions of the rotor surface, with the rotor surface defined (axially) intermediate thereto, preferably with respect to the axis of rotation of the rotor.

Alternatively, the rotor surface may be inclined, such that the orientation of the rotor surface may be viewed as being angularly offset from the perpendicular plane.

The rotor surface may present a facing angular orientation which is angularly intermediate of the perpendicular plane and a second plane which is orthogonal thereto which includes the axis of rotation.

More generally, the rotor surface may be orientated at an incline with respect to either a plane perpendicular to the axis of rotation, or with respect to the axis of rotation of the rotor.

The angle of orientation may be defined with reference to a line which connects end/distal portions of the rotor, when viewed in axial cross-section.

The device may comprise a rotational shaft and to which the rotor may be attached or integral with and may extend around the shaft.

The shaft may extend from at least one axial end of the rotor. The shaft may comprise two shaft portions, which each extend away from a respective axial end of the rotor. The shaft may comprise a unitary component which is arranged to extend through the rotor. The rotor may comprise a central opening through which a rotational shaft can be located. The shaft may be viewed as extending away from (at least) one side of the chamber.

The shaft may provide for rotational input to and/or output from the device.

A rotational bearing may be provided axially spaced from the annular chamber. At least two rotational bearings may be provided axially spaced from the annular chamber and spaced from each other. At least one bearing can also be provided within the axial extent of the chamber. The rotational bearings may be arranged such that the annular chamber is intermediate of the bearings, relative to the axis of rotation of the rotor. The bearings may be arranged so that there is a shaft through the rotor with bearings each side or could be arranged with the bearings only on one side, or could be arranged with a bearing under or axially within the chamber The rotor surface may be of generally flared profile, preferably when viewed in axial cross-section. The rotor surface (which in part defines the working chamber) may extend between a first rotor surface end region and a second rotor surface end region, and the first rotor surface end region being spaced along the axis of rotation of the rotor with respect to the second rotor surface end region, and one of the rotor surface end regions having a greater radial extent than the other end region, or each of the end regions may have substantially the same radial extent. Each of the end regions may be located at the distal or extreme region of the rotor surface, with respect to the axis of rotation.

The rotor surface may be at least one of continuous, smooth and curved.

The rotor surface may be provided with one or more ports to allow communication of fluid between the annular chamber and a space external of the chamber.

The port or ports may comprise an opening which extends through to an opening in a rearward surface of the rotor surface which in part defines the working chamber. The rearward surface may be spaced from the rotor surface, in a direction generally along the axis of rotation.

A port in communication with the working chamber may exit a portion of face of the rotor that is axially spaced from the rotor surface.

This may be viewed as providing working fluid porting to or from the annular chamber through the rotor surface.

The axis of rotation of the rotor may be substantially orthogonal to the axis of rotation of the shutter. The axis of rotation may be at a non-orthogonal angle to the axis of rotation of the shutter.

The stator may comprise a structure which substantially accommodates or contains or packages the rotor and the shutter. The stator may comprise two or more parts or sub-assemblies which, when connected together, collectively at least partially or substantially enclose the rotor and the shutter.

The annular chamber may be termed an annular, or circular, working cylinder or space.

The term 'piston' is used herein in its widest sense to include, where the context admits, a partition capable of moving relative to a cylinder wall, and such partition need not generally be of substantial thickness in the direction of relative movement but can be in the form of a blade or vane. The piston may be arranged to rotate, in use, around the axis of rotation of the rotor. The piston is preferably fixed such that there is minimal or no relative movement between it and the rotor.

Although in theory the shutter could be reciprocable, it is preferred to avoid the use of reciprocating components, particularly when high speeds are required, and the shutter preferably comprises at least one rotatable shutter disc provided with at least one aperture which in the open condition of the shutter is arranged to be positioned substantially in register with the circumferentially- or circularly-extending space of the annular cylinder space to permit passage of the at least one piston through the (aperture of the) shutter disc.

The shutter may present a partition which extends substantially radially of the cylinder space.

The at least one aperture of the shutter may be provided substantially radially in, and with respect to, the shutter.

Preferably the axis of rotation of the rotor is non-parallel to the axis of rotation of the shutter.

Preferably the piston is so shaped that it will pass through an aperture in the moving shutter, without balking, as the aperture passes through the annular cylinder space. The piston may be shaped so that there is minimal clearance between the piston and the aperture in the shutter, such that a seal is formed as the piston passes through the aperture. A seal may be provided on a leading or trailing surface or edge region of the piston.

The term 'seal' is used throughout this text in its widest sense to include allowance for an intentional leak path of fluid, by way of a close-spacing between opposed surfaces, and not necessarily forming a fluid-tight formation. Within this scope a seal may be achieved by way of close-running surfaces or a close-running line or a close-running region. The seal may be provided by a sealing gap between opposing surfaces, to minimise or restrict transmission of fluid therethrough. The sealing gaps corresponding to different surfaces may have varying clearances to their respective opposing parts, due to different assembly and operational requirements.

In the case of a compressor, a seal could be provided on a leading surface of the piston and in the case of an expander a seal could be provided on a trailing surface.

The rotor is preferably rotatably supported by the stator rather than relying on co-operation between the piston and the cylinder walls to relatively position the rotor body and stator. It will be appreciated that a rotary piston and cylinder device is distinct from a conventional reciprocating piston device in which the piston is maintained coaxial with the cylinder by suitable piston rings or regions of the piston which give rise to relatively high friction forces.

The seal between the rotor and the circumferential surface of the shutter disc may be provided by a sealing gap therebetween, which is arranged to minimise transmission of fluid.

The rotor may be rotatably supported by suitable bearing means carried by the stator.

Preferably the stator comprises one or more ports which may include one or more inlet and one or more outlet ports.

At least one of the ports may be substantially adjacent to the shutter.

Preferably the ratio of the angular velocity of the rotor to the angular velocity of the shutter disc is 1:1, although other ratios are possible.

The rotor may comprise a circular surface which is concave or curved in cross-section, and which defines in part, with the stator, the annular chamber. The surface of the rotor which in part defines the cylinder space may be of dished or bowled shape or configuration.

The shutter may be arranged to extend through or intersect the cylinder space at (only) one region or location of the cylinder space.

The device, and any feature of the device, may comprise one or more structural or functional characteristics described in the description below and/or shown in the drawings, either individually or in combination.

BRIEF DESCRIPTION OF THE DRAWINGS

Various embodiments of the invention will now be described, by way of example only, with reference to the following drawings in which.

DETAILED DESCRIPTION

Figure 1:
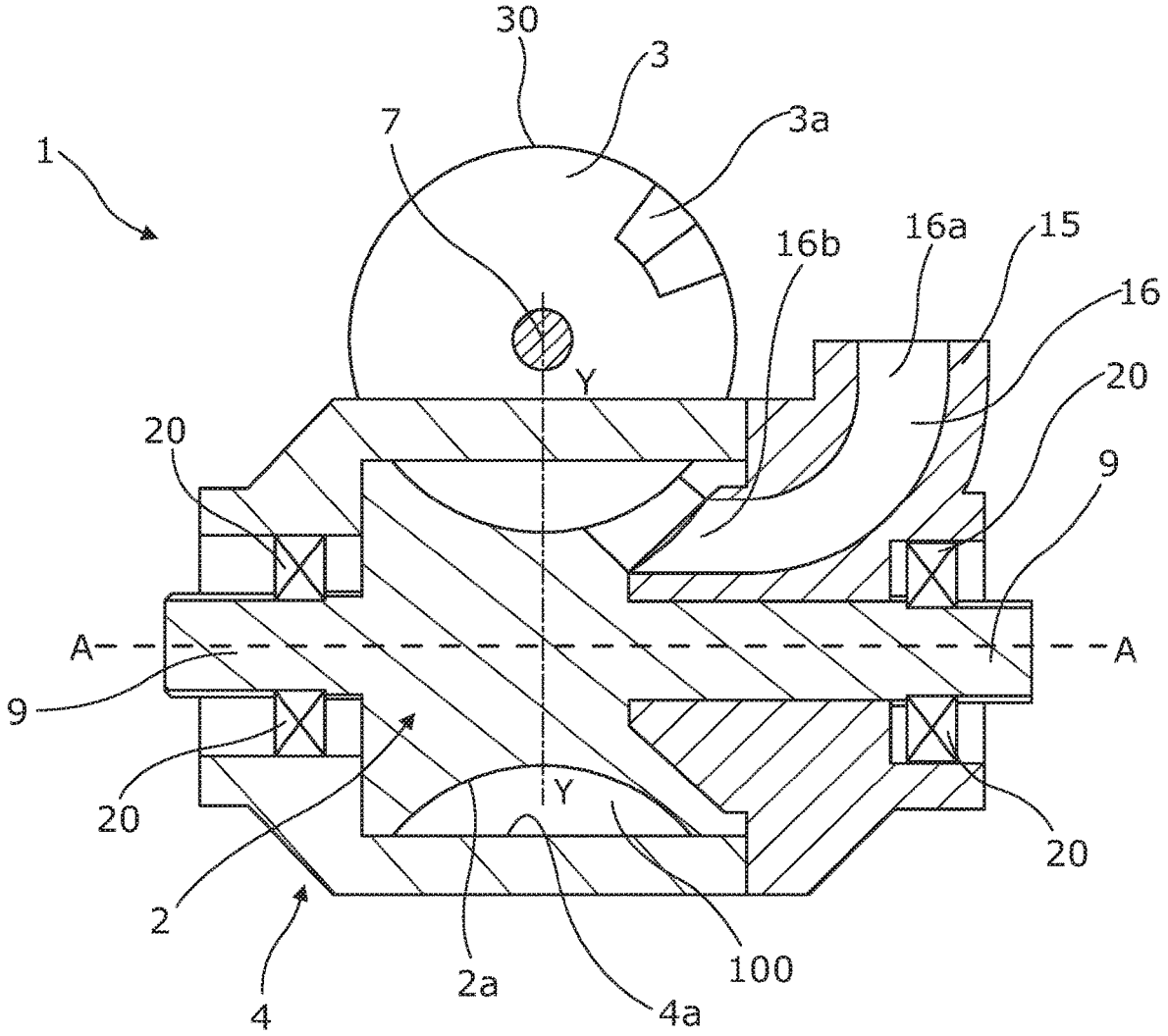
FIG. 1 is an axial cross-section of a rotary piston and cylinder device.

Reference is made to the Figures which show a rotary piston and cylinder device 1 which comprises a rotor 2, a stator 4, and a shutter disc 3. The stator comprises a formation, such as a housing or casing, which is maintained relative to the rotor, and an internal surface of the stator facing a surface 2*a* of the rotor, together define an annular space or working chamber, shown generally at 100. The stator 4 may comprise two or more parts, which together substantially enclose the rotor and shutter therebetween.

Integral with the rotor and extending from the surface 2*a* there is provided a piston 5. A slot or opening 3*a* provided in the shutter disc 3 is sized and shaped to allow passage of the piston therethrough. Rotation of the shutter disc 3 is arranged to ensure that the timing of the shutter remains in synchrony with the rotor by a suitable transmission.

A transmission assembly, not illustrated, can rotationally connect and synchronise the rotation of the shutter to the rotor. The transmission assembly may include a multiple toothed gears or another transmission type. The shutter disc 3 is rotationally mounted by way of a shaft portion 7.

In use of the device, a circumferential surface 30 of the shutter disc faces the surface 2*a* of the rotor so as to provide a seal therebetween, and so enable the shutter disc to functionally serve as a partition within the annular cylinder space.

The geometry of the interior (i.e. facing into and in part defining the chamber) surface 2*a* of the rotor is governed by the part of the circumferential surface 30 of the rotating shutter disc.

The rotor and the stator are configured to provide the annular cylinder space with one or more inlet port/s and one or more outlet port/s for the working fluid, as described in further detail below.

The rotor 2 is located intermediate of distal end portions of the shaft 9. Depending on how the device 1 is used, in terms of its operational application, the shaft may be used to provide rotational input or output.

As is evident, since the piston 5 is of relatively wide dimension, the opening 3*a* of the shutter 3 must be accordingly proportioned, in order to allow the piston to pass through the opening. It will be appreciated, and is to some extent evident in the drawings, that the boundary of the opening 3*a* has to be suitably configured/profiled to take account of the relative movement between the piston and the shutter disc.

The rotor 2 is provided with multiple ports 10 which extend from the surface 2*a* through to the opposite, or what could be termed outward, surface of the rotor. As will be described further below, this conveniently allows for fluid to be transferred to or from the annular or working chamber of the device. This may be for example compressed fluid.

Depending from the stator 4, there is provided a formation 15, which in this example may be described as a spigot. This feature provides a port, such as an outlet port, for working fluid from the device. The formation 15 comprises a passageway 16 with an opening 16*a*, and the opposite end of the passageway 16 is provided with an opening 16*b*. The ports 10 of the rotor are arranged to periodically come into register with the opening 16*b* of the stator. It will be appreciated that the view in FIG. 1 shows a port 10 in alignment with the port 16*b*.

This means that as the rotor 2 rotates and the port 10 comes into alignment with the opening 16*b*, and passage 16 is opened through which fluid can flow into and/or out of the annular chamber 100.

During assembly or manufacture of the device 1, the component parts of the stator, can be rigidly attached together by way of fasteners or by some other way.

Figure 2:
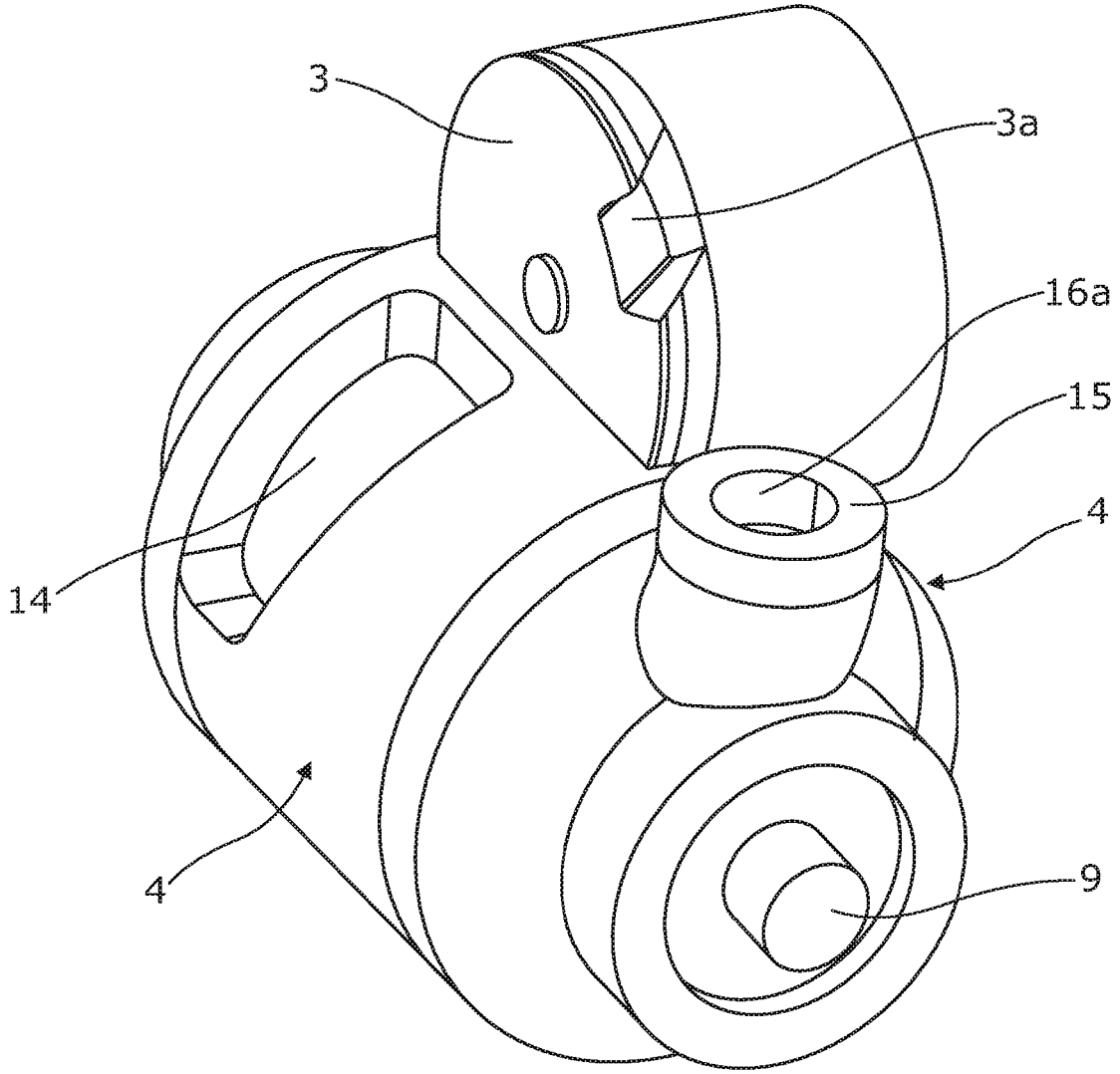
FIG. 2 is a perspective view of the rotary piston and cylinder device of FIG. 1.
Figure 3:
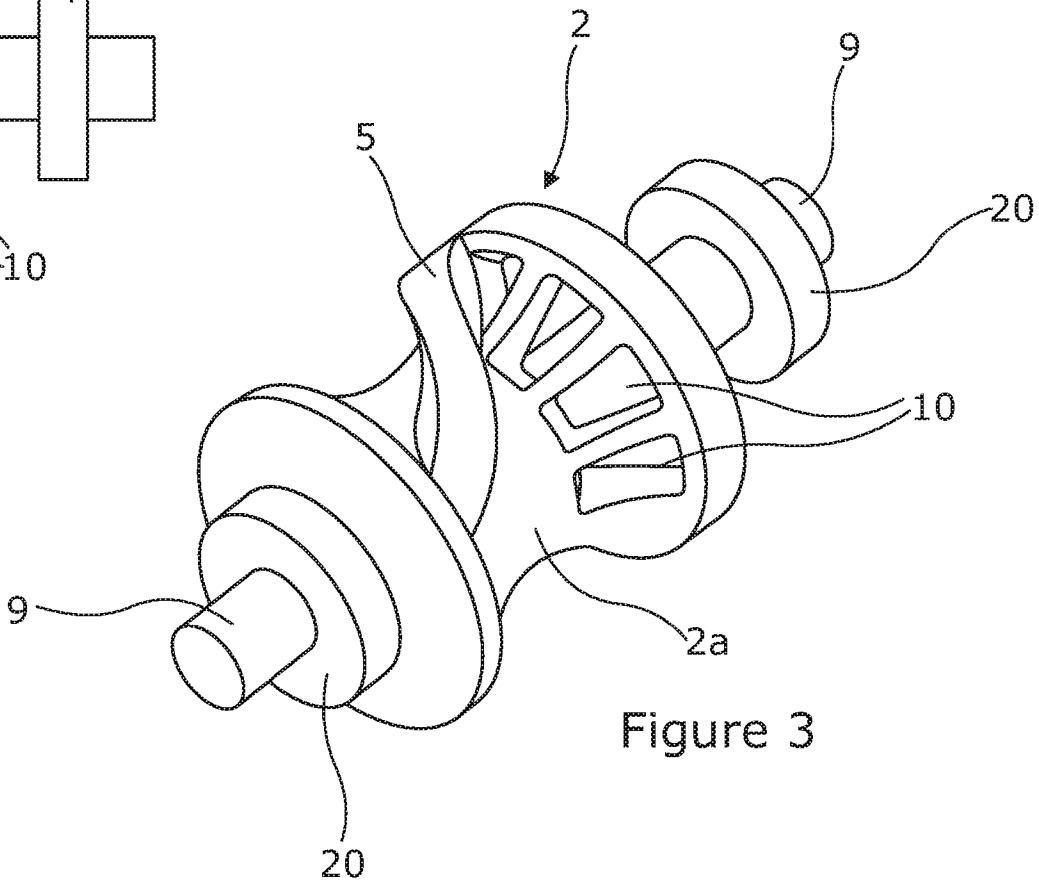
FIG. 3 is perspective view of a rotor of the device of FIG. 1.
Figure 3A:
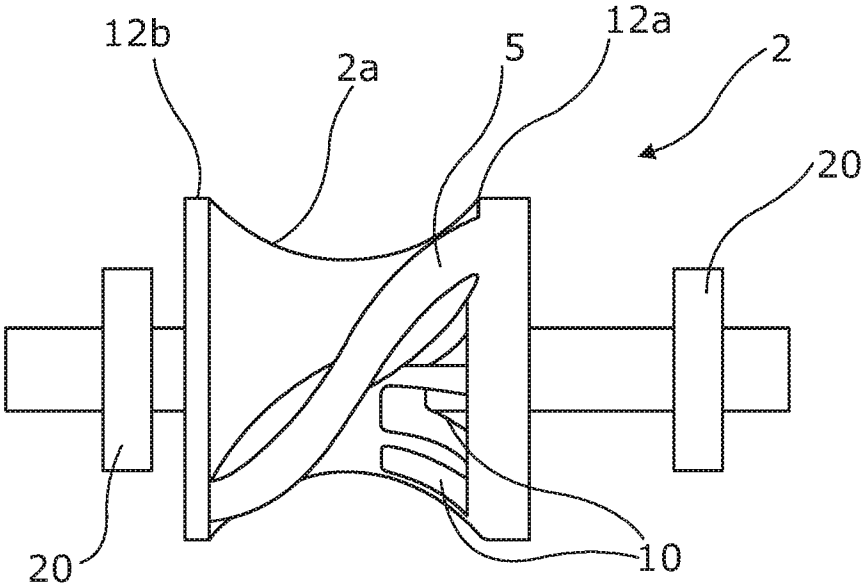
FIG. 3*a* is a perspective view of the rotor of FIG. 3.

The chamber 100 is also defined by an internal (i.e. facing into the chamber) surface 4*a*. Save for the presence of a port 14 (shown in FIG. 2), the surface 4*a* is substantially cylindrical shape. This means, as seen in (axial) cross-section of the chamber the surface 4*a* presents a single, major linear boundary to the chamber. In essence the chamber 100 (when considered in cross-section of a plane incorporating the axis of rotation of the rotor) is substantially defined by two major surfaces/sides (i.e. the rotor surface 2*a* and the stator surface 4*a*), and what may be termed a two-sided chamber.

The rotor surface 2*a* is of substantially concave cross-section, and when considered as a whole can be viewed as presenting the surface of a diabolo.

The shaft 9 being rotatably mounted by bearings 20 is arranged to rotate about an axis A-A.

The port 14 can provide an inlet for working fluid. If the device 1 is used as a compressor, a suitable motive or drive source can be attached to the shaft 9 or to the shaft 7 of the shutter or to another part of the transmission.

The surface 2*a* of the rotor 2 may be described as being substantially symmetric about the axis of rotation of the rotor. This can be better understood with reference to the plane Y-Y, which extends through a midpoint of the rotor surface 2*a*, and which is perpendicular to the axis of rotation A-A. About this plane, the rotor surface is substantially symmetrical. Put an alternative way, the general orientation/direction of the rotor surface 2*a* is directed substantially perpendicularly to the axis of rotation A-A.

Figure 4:
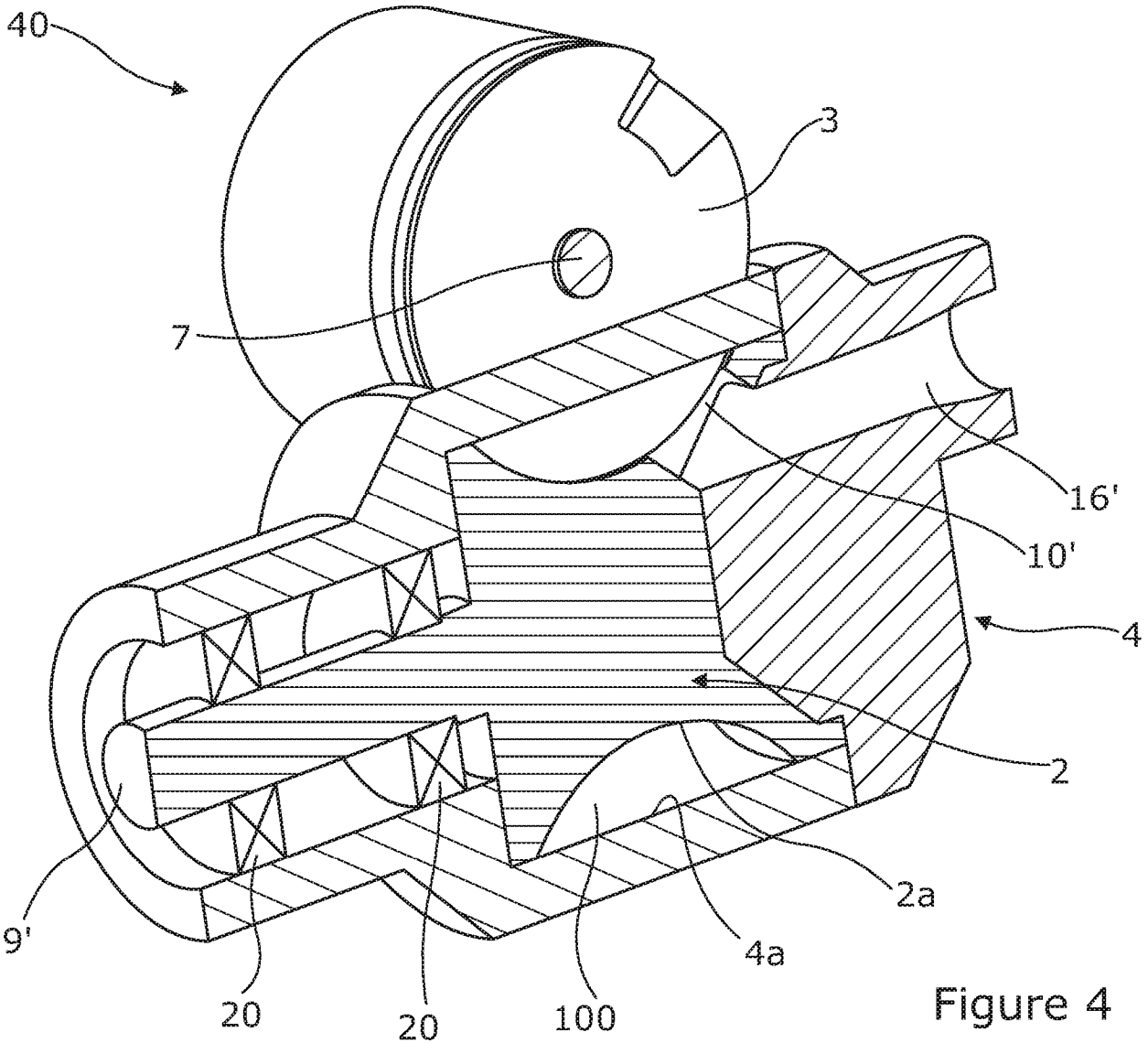
FIG. 4 is a cross-sectional perspective view of a variant embodiment to that shown in FIG. 1.

In FIG. 4 a modified version 40 of the device 1 is shown in which an extended shaft 9' is provided with two bearings 20, in essence both being located to one side of the chamber 100. The arrangement of a passageway 16' extends along the stator 4. Such an arrangement can allow a larger cross-section of passageway 16' than otherwise possible, since all the shaft and bearings are located towards the other side of the chamber. The version 40 of the device also comprises a port 10'.

Figure 5:
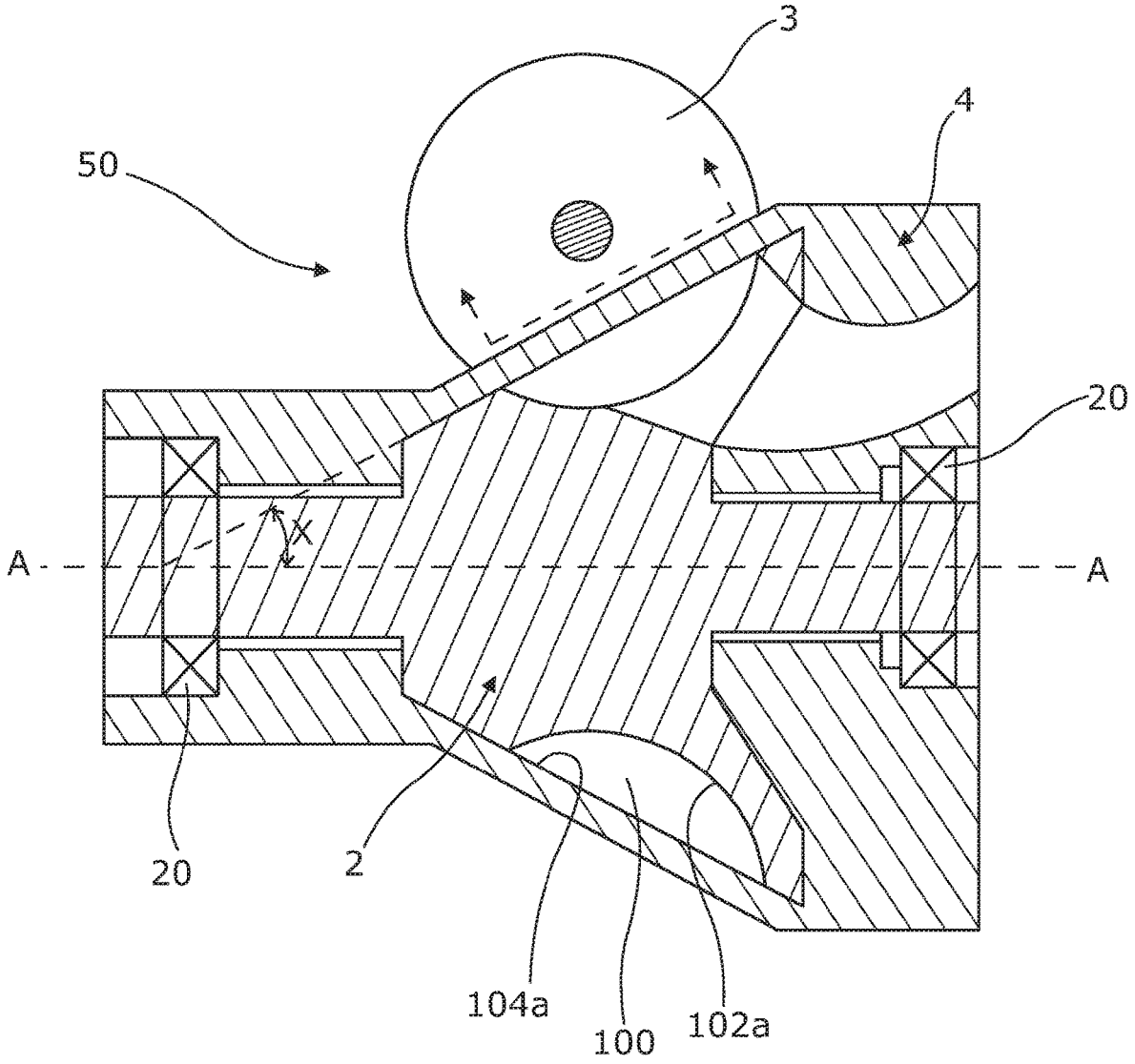
FIG. 5 is a further variant embodiment of a rotary piston and cylinder device.

Reference is made to FIG. 5 which shows a further embodiment 50 in which the rotor surface is orientated at an incline relative to the axis of rotation of the rotor 2, as schematically illustrated by the headed broken line. This results in the requirement that the single major surface 104*a* of the stator which defines in part the chamber is of substantially frusto-conical shape. A surface 102*a* of the rotor co-defines the chamber with the surface 104*a* of the stator 4.

Some of the geometrical characteristics of the outward, inclined orientation of the device 50 are now discussed. FIG. 5 serves to illustrate the geometric characteristic of the rotor 2 of the device 50. The rotor surface 102*a* may be described as being orientated an incline relative to the axis of rotation A-A.

The inclined, outward, orientation of the rotor surface 102*a* can be described, by extrapolating the surface 102*a*, which in essence extends between the distal end regions of the rotor surface 102*a*, towards the axis of rotation of A-A. That line can then be extended to intercept the axis A-A, at a particular angle of incline x.

The invention claimed is:

1. A rotary piston and cylinder device comprising:

a rotor including a rotor surface, a piston which extends from the rotor surface only partially around the rotor surface, a stator at least partially enclosing the rotor and having a single continuous and unjointed surface, a rotatable shutter having a shaft and a single slot, an annular chamber that at least partially surrounds the rotor, the annular chamber being defined only by the rotor surface and the single continuous and unjointed surface of the stator together and at least a portion of the annular chamber is arc-shaped when viewed in axial cross-section, and a transmission, wherein the piston is arranged to rotate through the annular chamber when the rotor rotates and the rotatable shutter rotates being driven through the transmission from the shaft so that the rotation of the rotatable shutter is synchronized to the rotation of the rotor, and the single slot of the rotatable shutter is configured to allow passage of the piston during the respective rotations of the rotor and the rotatable shutter.

2. A device as claimed in claim 1 in which the single continuous and unjointed surface of the stator is a major surface of the stator which defines the annular chamber.

3. A device as claimed in claim 1 in which the single continuous and unjointed surface of the stator when viewed in the axial cross-section is substantially linear.

4. A device as claimed in claim 1 in which the single continuous and unjointed surface of the stator is substantially cylindrical.

5. A device as claimed in claim 1 in which the single continuous and unjointed surface of the stator is disposed radially outward of the rotor surface.

6. A device as claimed in claim 1 in which the rotor surface is of substantially diabolo shape/configuration.

7. A device as claimed in claim 1 in which the rotor surface is substantially symmetrical with respect to a plane which extends through a mid-region of the rotor surface, and which plane is perpendicular to an axis of rotation of the rotor.

8. A device as claimed in claim 1 in which at least a portion of the rotor surface adjacent to the annular chamber is inclined, such that the orientation of the at least a portion of the rotor surface may be viewed as being angularly offset from a plane which is perpendicular to an axis of rotation of the rotor.

9. A device as claimed in claim 1 in which the rotor surface has a flared profile when viewed in the axial cross-section, and the rotor surface extends between a first rotor surface end region and a second rotor surface end region, and the first rotor surface end region is spaced along an axis of rotation of the rotor with respect to the second rotor surface end region.

10. A device as claimed in claim 1 in which the rotor surface extends between a first rotor surface end region and a second rotor surface end region, and the first rotor surface end region is spaced along an axis of rotation of the rotor with respect to the second rotor surface end region, or each of the end regions have substantially the same radial extent, and each of the two end regions has a flared profile when viewed in the axial cross-section.

11. A device as claimed in claim 1 in which the rotor surface is provided with one or more ports to allow communication of working fluid between the annular chamber and a space external of the annular chamber.

12. A device as claimed in claim 11 in which the one or more ports comprise an opening which extends through to an opening in a rearward surface of the rotor surface which in part defines the annular chamber.

13. A device as claimed in claim 12 in which the rearward surface is spaced from the rotor surface in a direction along an axis of rotation of the rotor.

14. A device as claimed in claim 11 in which the one or more ports is in communication with the annular chamber from which exits a portion of a face of the rotor that is axially spaced from the rotor surface.

15. A device as claimed in claim 14 in which the one or more ports is arranged to provide the working fluid porting to or from the annular chamber through the rotor surface.

* * * * *